United States Patent [19]

Larin et al.

[11] Patent Number: 5,014,517

[45] Date of Patent: May 14, 1991

[54] CRYOGENIC SORPTION PUMP

[76] Inventors: Marxen P. Larin, prospekt Nauki, 29, kv. 78; Maxim L. Alexandrov, prospekt Engelsa, 63, korpus 3, kv. 89; Valery I. Nikolaev, prospekt Rentgena, 15/31, kv. 8, all of, Leningrad, U.S.S.R.

[21] Appl. No.: 439,366

[22] PCT Filed: Feb. 10, 1989

[86] PCT No.: PCT/SU89/00036

§ 371 Date: Nov. 14, 1989

§ 102(e) Date: Nov. 14, 1989

[87] PCT Pub. No.: WO89/08781

PCT Pub. Date: Sep. 21, 1989

[30] Foreign Application Priority Data

Mar. 10, 1988 [SU] U.S.S.R. ..... 4391234

[51] Int. Cl.[5] ..... B01D 8/00

[52] U.S. Cl. ..... 62/55.5; 55/269; 417/901

[58] Field of Search ..... 62/55.5; 55/269; 417/901

[56] References Cited

U.S. PATENT DOCUMENTS

| | | | |
|---|---|---|---|
| 3,157,480 | 11/1964 | Van Beukering | 62/55.5 |
| 3,220,167 | 11/1965 | Van Der Ster et al. | 62/55.5 |
| 3,310,227 | 3/1967 | Milleron | 62/55.5 |
| 3,335,550 | 8/1967 | Stern | 62/55.5 |
| 3,416,326 | 12/1968 | Stuffer | 62/55.5 |
| 3,552,485 | 1/1971 | Le Jannou et al. | 62/55.5 |
| 3,668,881 | 6/1972 | Thibault et al. | 62/55.5 |
| 3,788,096 | 1/1974 | Brilloit | 62/55.5 |

FOREIGN PATENT DOCUMENTS

| | | | |
|---|---|---|---|
| 269394 | 6/1970 | U.S.S.R. . | |
| 547549 | 5/1977 | U.S.S.R. | 62/55.5 |
| 659792 | 4/1979 | U.S.S.R. | 62/55.5 |
| 696176 | 11/1979 | U.S.S.R. | 62/55.5 |
| 992814 | 1/1983 | U.S.S.R. | 62/55.5 |
| 1333833 | 8/1987 | U.S.S.R. . | |
| 1439278 | 11/1988 | U.S.S.R. . | |
| 1143277 | 11/1969 | United Kingdom . | |
| 1388122 | 3/1975 | United Kingdom . | |

OTHER PUBLICATIONS

Journal of Technical Physics, M. P. Larin, Kondensatsionno-Absorbtsionnaya i Sorbtsionnaya Otkachka Pri Temperaurakh Tverdogo Azota, Zhurnal Tekhnicheskoy Fiziki, 1988, vol. 58, No. 10, Oct., Nauka Publisher, Leningrad Branch, pp. 2026-2039.

*Primary Examiner*—Ronald C. Capossela
*Attorney, Agent, or Firm*—Lilling & Lilling

[57] ABSTRACT

In the pumping element of a cryogenic sorption pump, a sorbent material is accommodated in annular spaces between heat conductor shells and porous screen shells, with the shells being attached to the cover of a cryogenic agent vessel so as to make good thermal contact therewith.

2 Claims, 1 Drawing Sheet

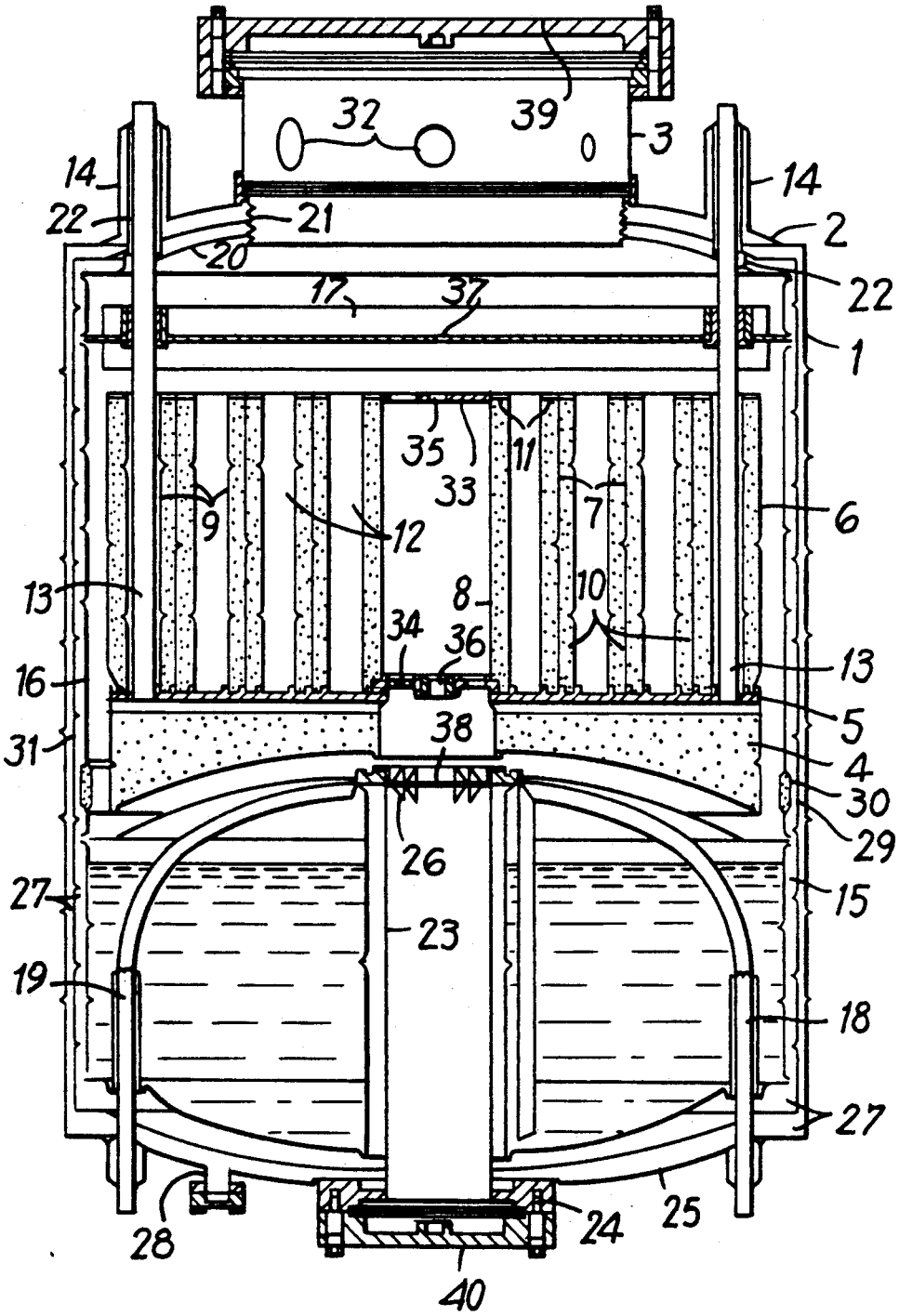
32
39
3
14
14
22
21
2
20
22
17
37
1
35
11
33
7
9
12
6
13
8
10
34
36
13
16
5
38
31
4
30
29
26
27
15
23
19
18
27
28
24
25
40

CRYOGENIC SORPTION PUMP

BACKGROUND OF THE INVENTION

1. Field of the Invention

The present invention relates to vacuum engineering, and more specifically, to cryogenic sorption pumps, and can be used to produce superclean and oil-free vacuum within a pressure range of $10^2$ to $10^{-7}$ Pa while evacuating any gases expecting helium and including corrosive ones from chambers of various designations, measuring from 0.01 to several hundred cubic meters in volume.

2. Description of the Related Art

There is known a cryogenic pump (SU, A, 1333833) comprising a pumping element consisting of a circular vessel containing liquid nitrogen, a porous screen arranged coaxially with the vessel within a space encompased by its inner side surface, and a sorbent located within the gap between the inner side surface of the vessel and the porous screen.

This pump is disadvantageous in that at the liquid nitrogen temperature the sorbent has a low sorption capacity at low equilibrium pressures (below $10^{-3}$ $-10^{-4}$ Pa) of adsorbable gases. As a result, this type of pump is incapable of providing limiting pressures of below $10^{-3}$ Pa even after a short-time gas load. To increase the sorption capacity of the pump, the sorbent may be cooled be means of solid nitrogen down to 55–50 K, but the sorbent cannot be maintained at these temperatures for a long time because of high natural heat input to the nitrogen-containing vessel, the nitrogen contents rapidly warming up after evacuation of nitrogen vapors is discontinued. The operation of this pump is hampered by the need for frequenctly charging the vessel with liquid nitrogen and repeatly evacuating nitrogen vapors.

Another prior-art cryogenic sortion pump (M. P. Larin, Kondensatsionno-adsorbtsionnaya i sorbtsionnaya otkachka pri temperaturakh tverdogo azota, Zhurnal tekhnicheskoy fiziki, 1988 , vol. 58, No. 10, October, Nauka Publisher (Leningrad Branch), pp. 2026–2039) comprises a housing complete with a cover fitted with an inlet nozzle for connection of the space to be evacuated and, arranged in the housing, a pumping element and cooled radiation screen encompassing the pumping element. The pumping element has the form of a circular vessel designed to contain cryogenic agent and perforated heat-concudctor and porous-screen shells installed in the space defined by the inner wall of the vessel and arranged coaxially therewith. The bottom of the vessel, the heat conductor shells, and the porous screen shells are welded to a heat conductor disc to provide thermal contact between the vessel and the heat conductor shells. Two porous screen shells are arranged on both sides of the vessel walls, and the remaining ones, on both sides of the heat conductor shells, with the annular spaces between the vessel walls and the porous screen shells, as well as the annular spaces between the heat conductor shells and the porous screen shells adjacent thereto, being filled with a sorbent material. Said sapces are covered over on top with rings. The annular spaces between the adjacent porous screen shells communicate with the inlet nozzle of the pump. The cryogenic agent vessel has a circular cover with two tubes to fill cryogenic agent into the vessel and remove cryogenic agent vapors therefrom. Said tubes have their top ends secured in the housing cover.

Owing to the incorporation of a liquid nitrogen-cooled radiation screen, the heat input from the housing to the pumping element is considerably reduced in this pump.

From the standpoint of increasing the sorption capacity of the pump, which is one of the main pumping characteristics, it is desirable that for a given pump size the sorbent should occupy the maximum possible volume while for higher pumping speeds the sorbent and the porous screens should have the maximum possible surface area. In the pump under discussion, the sorbent-filled spaces are enclosed in the pumping element vessel, with the exception of the outer space adjacent to the outer side surface of the vessel. In other words, the cryogenic agent vessel occupies a sufficiently large part of the pumping element volume, which does not participate directly in the pumping process while it could have been occupied by sorbent and porous screens. As for the outer sorbent-containing space surrounding the vessel, its performance is inefficient because of the low conductivity of the gap between said space and the radiation screen. It is for the above reasons that the sorption capacity and the pumping speed of said cryogenic sorption pump are not sufficiently high.

SUMMARY OF THE INVENTION

The invention is based upon the objective of providing a cryogenic sorption pump with a pumping element having heat conductor shells and porous screen shells so arranged relative to a vessel designed to contain cryogenic agent for cooling the sorbent to be accommodated within the spaces in between said shells that the volume of these spaces and the surface area of the porous screen shells might be increased to result in a higher sorption capacity and a higher speed for the pump.

The objective as stated above is achieved by providing a cryogenic sorption pump comprising a pumping element enclosed in a cooled radiation screen and incorporating a sorbent material accommodated in annular spaces formed by coaxially disposed heat conductor shells and porous screen shells, and a vessel designed to contain a cryogenic agent being in thermal contact with said shells, and having a cover, wherein, according to the invention, the heat conductor shells and porous screen shells are attached to the cover of the cryogenic agent vessel.

The attachment of the heat conductor shells and porous screen shells to the cover of the pumping element vessel designed to contain cryogenic agent permits removal of said vessel from the sorption zone under the sorption part of the pump. This makes it possible to increase the diameter of the heat conductor shells and porous screen shells, and hence to increase the surface area of the porous screens and thus the pumping speed. Increasing the diameter of the heat conductor shells and the porous screen shells will also increase the volume of the sorbent-containing spaces, i.e. the amount of sorbent used, the result being enhanced sorption capacity for the pump.

BRIEF DESCRIPTION OF THE DRAWINGS

In the following, the invention will be made more fully apparent by a detailed description of its preferred embodiment with due references to the accompanying drawing, wherein the proposed cryogenic sorption pump is illustrated in logitudinal section.

DESCRIPTION OF THE PREFERRED EMBODIMENT

The proposed cryogenic sorption pump has a housing 1 with a cover 2 provided with an inlet nozzle 3. The housing 1 accommodates a pumping element comprising a torodial vessel 4 designed to contain a cryogenic agent, the cover 5 of said vessel having coaxially arranged heat conductor shells 6, 7, and 8 and porous screen shells 9 welded to it. The outer and inner heat conductor shells 6 and 8, respectively, are fabricated from solid sheeting while the remaining heat conductor shells 7 are perforated. The material to be used for the shells 9 can be porous copper, as an example. The outer porous screen 9 is installed on the inner side of the heat conductor shell 6, the inner porous screen, on the outer side of the heat conductor shell 8, and the remaining porous screens 9 are arranged on both sides of the perforated heat conductors 7. The annular spaces 10 between the heat conductor shells 6, 7, and 8 and the porous screens 9 adjacent thereto are filled with a sorbent material, e.g. with active carbon. The perforations in the heat conductor shells 7 having sorbent on both sides are provided for the porpose of accelerating the process of equalizing the equilibrium pressure of gases over the sorbent material. Rings 11 serve to cover the spaces 10 on top. The annular spaces 12 between the adjacent porous screens 9 serves to pass the evacuated gases.

To the cover 5 of the torroidal vessel 4 are welded in a pressure tight manner two tubes 13 communicating with the vessel cavity. The top ends of these tubes 13 are brought out of the housing 1 and made fast in its cover 2 by means of branches 14. The tubes 13 serves to fill the pumping element vessel 4 with a cryogenic agent and to evacuate cryogenic agent vapors in order to reduce the cryogenic agent temperature in the vessel 4.

The pumping element is enclosed in a radiation screen in order to reduce heat input by radiation from the housing 1. The radiation screen comprises a toroidal vessel 15 designed to contain a cryogenic agent, a shell 16, and a chevron screen 17. The vessel 15 is located under the pumping element vessel 4, and the shell 16 has its lower part secured in a pressure tight manner to the vessel 15. Introduced into the vessel 15 are two tubes 18 and 19, the tube 18 being used to fill a cryogenic agent into the vessel 15, while the tube 19 serves for removal of cryogenic agent vapors. In its upper part, the shell 16 has a cover 20 attached through a bellows-like heat bridge 21 to the input nozzle 3. To the cover 20 of the shell 16 are welded branches 22 whose top ends are welded in a vacuum tight manner with the tubes 13 and branches 14. The chervon screen 17 is installed between the pumping element and the inlet nozzle 3 and attached to the top part of the shell 16 to make a good thermal therewith.

Installed in the space defined by the inner wall of the radiation screen 15 is a thin-walled pipe 23, whose lower end is welded to a flange 24 attached to the bottom 25 of the housing 1, and whose whole upper end is welded to the cover of the vessel 15. Installed across the pipe 23 in its upper section is a chervon screen 26.

The space defined by the shell 16, the outer wall of the vessel 15, the bottom of said vessel, the inner wall of said vessel, the pipe 23, and the housing 1 make a so-called protective vacuum space 27 which reduces heat input from the housing 1 to the pumping element, said heat input being due to heat exchange by residual gases within this space. The protective vacuum space 27 can be evacuated through a nozzle 28 located on, e.g., the bottom 25 of the housing 1. In order to maintain the desired vacuum level in the space 27 under operating conditions, the shell 16 is provided with a circular recess 29 filled with a sorbent material and covered over by a porous screen 30.

Installed between the housing 1 and the radiation screen is an additional screen 31 designed to reduce heat input by radiation from the housing 1 to the radiation screen.

On the side wall of the inlet nozzle 3 there are two nozzles 32, of which one is used to connect a fore pump via a valve while the other serves for connection of a measuring pressure transducer to control the vacuum level in the inlet nozzle 3.

Installed in the pump channel, along the pump axis, are discs 33 and 34 with holes 35 and 36, respectively, while the chevron screens 17 and 26 are provided with holes 37 and 38, respectively, to pass a transportation rod to be fastened by means of a threaded connection in the hole 36 of the disc 34 and in blind flanges 39 and 40.

All surfaces of pump elements, expecting those of the chevron screens 17 and 26, facing the space to be evacuated, have a two-layer coating consisting of a dense layer of aluminium at least 1 $\mu$m thick and an aluminum oxide layer of 2 to 20 nm thickness. The chevron screens 17 and 26 have coatings of at least 150 $\mu$m thickness with an emissivity factor not lower than 0.99 within a wavelength range of 2 to 200 $\mu$m.

The proposed pump operates as follows.

Connected to the inlet nozzle 3, directly or through a seal (not shown), is a working chamber to be evacuated (not shown). A mechanical fore pump is connected to the nozzle 28, via a valve (not shown) with a metallic seal, and used to evacuate the protective vacuum space 27 until a pressure of 100–40 Pa is reached therein. Then the pump space and a working chamber—if it is directly connected to the pump—are evacuated through one of the nozzles 32, via a valve (not shown), down to a pressure of, likewise, about 100–40 Pa. Cryogenic agent, e.g. liquid nitrogen, is filled into the radiation screen vessel 15 via the tube 18. Cooling the vessel 15 will also cool the sorbent accommodated in the circular recess 29 of the shell 16, leading to a reduction in the pressure in the space 27 down to $10^{-4}$–$10^{-5}$ Pa or lower and to a drastic decrease in the heat exchange by residual gases between the housing 1 and the radiation screen.

Next, cryogenic agent is filled into the pumping element vessel 4 through one of the tubes 13, with a temperature lower than that of the cryogenic agent in the vessel 15, thus liquid hydrogen or helium, or else the same cryogenic agent, e.g. liquid nitrogen. In the latter case, lower cryogenic agent temperature is achieved in the vessel 4 by evacuating cryogenic agent vapors with the aid of a mechanical fore pump connected to the tubes 13. With the fore pump having a capacity of, e.g., 16 l/s, two hours of pump operation will suffice to lower the solid nitrogen temperature to about 55K, with down to 50K or lower obtainable during the next four hours of evacuation.

Cooling of the sorbent accommodated in the annular spaces 10 of the pumping element is through the medium of the heat conductors 6, 7, and 8, at the same time with the vessel 4. The sorbent absorbs the gases coming from the working chamber, assuring a limiting pressure of down to $10^{-7}$ Pa or lower. With the sorbent temperature of about 50K, the sorption capacity of the sorbent material is increased several orders of magnitude compared to that at 77.4K, or else the equilibrium pressure is decreased by 3 to 4 orders of magnitude after adsorption of the same quantity of gas. On completion of said operations the pump is ready for work and can be used to evacuate the working chamber. Removal of nonadsorbable gases (helium, neon) is by means of a magnetic pump (not shown) jointed to the flange 24.

Owing to the sorbent-containing spaces 10 being distributed practically all over the pump cross-section within the space encompassed by the radiation screen shell 16, the total surface area of the porous screens 9 is increased, and so are the volumes of the sorbent-containing spaces 10 and the sectional area of the spaces 12 designed to pass the evacuated gases between adjacent porous screens 9. As a result, the pumping speed of the proposed pump design is increased by about 30%, and its sorption capacity by about 15%, as compared to the prior-art pump (M. P. Larin, Kondensatsionno-adsorbtsionnaya i sorbtsionnaya otkachka pri temperaturakh tverdogo azota, Zhurnal tekhnicheskoy fiziki, 1988, vol 58, No. 10, October, Nauka Publishers (Leningrad Branch), pp. 2026–2039) of identical size.

An additional advantage of the present invention, due to the installation of the heat conductors 6, 7, and 8 and the porous screens 9 on the cover 5 of the pumping element vessel 4, consists in the tubes 13 of the vessel 4 having a greater length than in the prior-art pump. It is for this reason that the heat flow through said tubes to the vessel 4 is decreased. To assure the desired speed of evacuation of nitrogen vapors from the vessel 4, the diameter of the tubes 13 may be increased accordingly.

The invention can be used for evacuation of spraying and plasma chemical units in, e.g., electronic industries, as well as for obtaining clean and oil-free vacuum within a pressure range of $10^2$ to $10^{-7}$ Pa in vacuum engineering while solving a broad spectrum of problems.

What is claimed is:

1. A cryogenic sorption pump, comprising:

a cold radiation screen; and a pumping element, encompassed by said cold radiation screen, comprising:

a vessel for cryogenic agent having an axis and a cover;

heat conductor shells mounted co-axially with said axis of said vessel, and secured to and in thermal contact with said cover of said vessel;

porous-screen shells secured to and in thermal contact with said cover of said vessel, and mounted co-axially with said heat conductor shells so that annular spaces are formed between each of said heat conductor shells and an adjacent porous-screen shell, said annular spaces being filled with an adsorbent.

2. A cryogenic sorption pump, according to claim 2, wherein adjacent porous-screen shells define additional annular spaces through which vapors to be adsorbed by said adsorbent can pass.

* * * * *